US005620108A

United States Patent [19]

Hsu

[11] Patent Number: 5,620,108

[45] Date of Patent: Apr. 15, 1997

[54] LAUNDRY CONTAINER

[75] Inventor: Peyson Hsu, Changhua Hsien, Taiwan

[73] Assignee: Cheng Feng Blinds Ind. Co., Ltd., Changhua Hsien, Taiwan

[21] Appl. No.: 578,939

[22] Filed: Dec. 27, 1995

[51] Int. Cl.[6] ..... B65D 6/18

[52] U.S. Cl. ..... 220/4.34; 206/600; 220/4.28; 220/668

[58] Field of Search ..... 206/278, 600; 220/4.28, 4.29, 4.32, 4.33, 4.34, 666, 668; 217/15

[56] References Cited

U.S. PATENT DOCUMENTS

| | | | |
|---|---|---|---|
| 4,782,972 | 11/1988 | Wenkman et al. | 220/4.28 |
| 5,161,709 | 11/1992 | Oestreich, Jr. | 220/4.28 |
| 5,253,763 | 10/1993 | Kickley et al. | 206/600 |

*Primary Examiner*—David T. Fidei
*Attorney, Agent, or Firm*—Browdy and Neimark

[57] ABSTRACT

A laundry container including a cover body, a waterproof shade, a base seat, an upper frame, two support plate assemblies and two fixing beams. The base seat has an outer and an inner peripheries which define a peripheral groove. Several bosses are disposed on left and right outer sides of the inner periphery. The upper frame has an outer and an inner peripheries which define a peripheral groove. Several bosses are disposed on left and right outer sides of the inner periphery. Each support plate assembly includes an upper support plate and a lower support plate. The upper support plate has a horizontal face along upper edge and a flange along outer edge of the horizontal face. Several dents are formed on inner side of the flange. Two projections are disposed at two ends of lower edge of the upper support plate. Several fitting sleeves are disposed on the lower edge thereof. The lower support plate has a horizontal face along lower edge and a downward extending flange along outer edge of the horizontal face. Several dents are formed on inner side of the flange. Two projections are disposed at two ends of upper edge of the lower support plate. Several insertion bodies are disposed on the upper edge thereof. Each insertion body has an insertion pin. The insertion pin has a ball head and is cut with a fissure.

3 Claims, 8 Drawing Sheets

LAUNDRY CONTAINER

BACKGROUND OF THE INVENTION

The present invention relates to a Laundry container including a cover body, a waterproof shade, a base seat, an upper frame, two support plate assemblies and two fixing beams. The upper frame and base seat are supported by the two support plate assemblies and the fixing beams and thus the laundry container has more concrete structure so that even in the case that the laundry container containing heavy weight of laundry is moved, the laundry container will not swing to cause detachment of the base seat from the support plate assemblies.

FIG. 1 shows a conventional laundry container including a base seat 10, an upper frame 20, a cover body 30, four support columns 40 and a waterproof shade 50. The base seat 10 has an upward projecting periphery 11 and four projections 12 on four corners, which are arranged by an angle of 45 degrees. The upper frame 20 has a downward projecting periphery 21, an inward extending flange 22 and four projections 23 on four corners, which are arranged by an angle of 45 degrees. The cover body 30 is pivotally connected with a rear edge of the upper frame 20. Each support column 40 has a semi-circular cross-section. The upper periphery of the waterproof shade 50 is secured on the periphery of the upper frame 20 and the lower periphery of the waterproof shade 50 is secured on the periphery of the base seat 10.

Please refer to FIG. 2. When assembled, the lower ends of the four support columns 40 are inserted between the four projections 12 and the four corners of the base seat 10 and the upper ends of the support columns 40 are inserted between the projections 23 and four corners of the upper frame 20 so as to stretch the waterproof shade 50 and complete the assembly.

According to such arrangements, the conventional laundry container has several shortcomings as follows:

1. The laundry container is only supported by four support columns 40 and wrapped by the waterproof shade 50 so that the structural strength is of the laundry container is quite weak and the laundry container is apt to swing.

2. The upper and lower ends of the support columns 40 are engaged with the upper frame 20 and the base seat 10 only by insertion without other reinforcing structure. Therefore, in the case that the laundry container containing heavy weight of laundry is moved, the base seat 10 is apt to detach from the support columns 40 to lead to collapse of the laundry container.

SUMMARY OF THE INVENTION

It is therefore a primary object of the present invention to provide a laundry container in which the upper frame and base seat are supported by two support plate assemblies and two fixing beams so that the laundry container has more concrete structure without swinging.

It is a further object of the present invent ion to provide the above laundry container in which the upper frame and the base seat are more firmly connected with the support plate assemblies by means of the engagement between bosses and dents so that the case that the laundry container containing heavy weight of laundry is moved, the laundry container will not swing to cause detachment of the base seat from the support plate assemblies.

The present invention can be best understood through, the following description and accompany drawings, wherein:

BRIEF DESCRIPTION OF THE DRAWINGS

FIG. 4D-1 is an enlarged sectional view of part D of FIG. 4;

FIG. 4D-2 is an enlarged sectional view of part D of FIG. 4 according to another embodiment;

FIG. 4D-3 is an enlarged sectional view of part D of FIG. 4 according to still another embodiment.

DETAILED DESCRIPTION OF THE PREFERRED EMBODIMENTS

Figure 1:
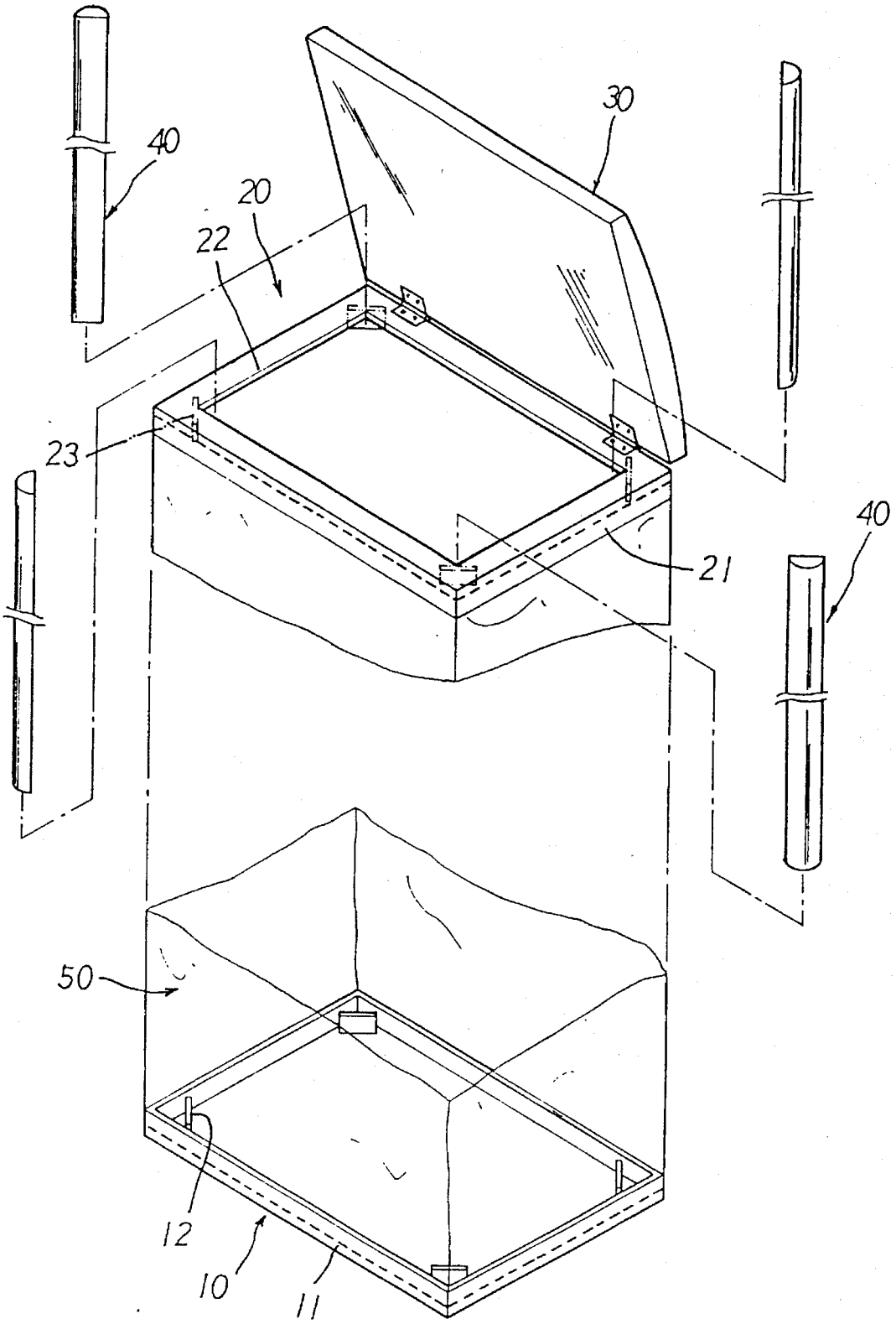
FIG. 1 (PRIOR ART)
FIG. 1 is a perspective exploded view of a conventional laundry container.
Figure 2:
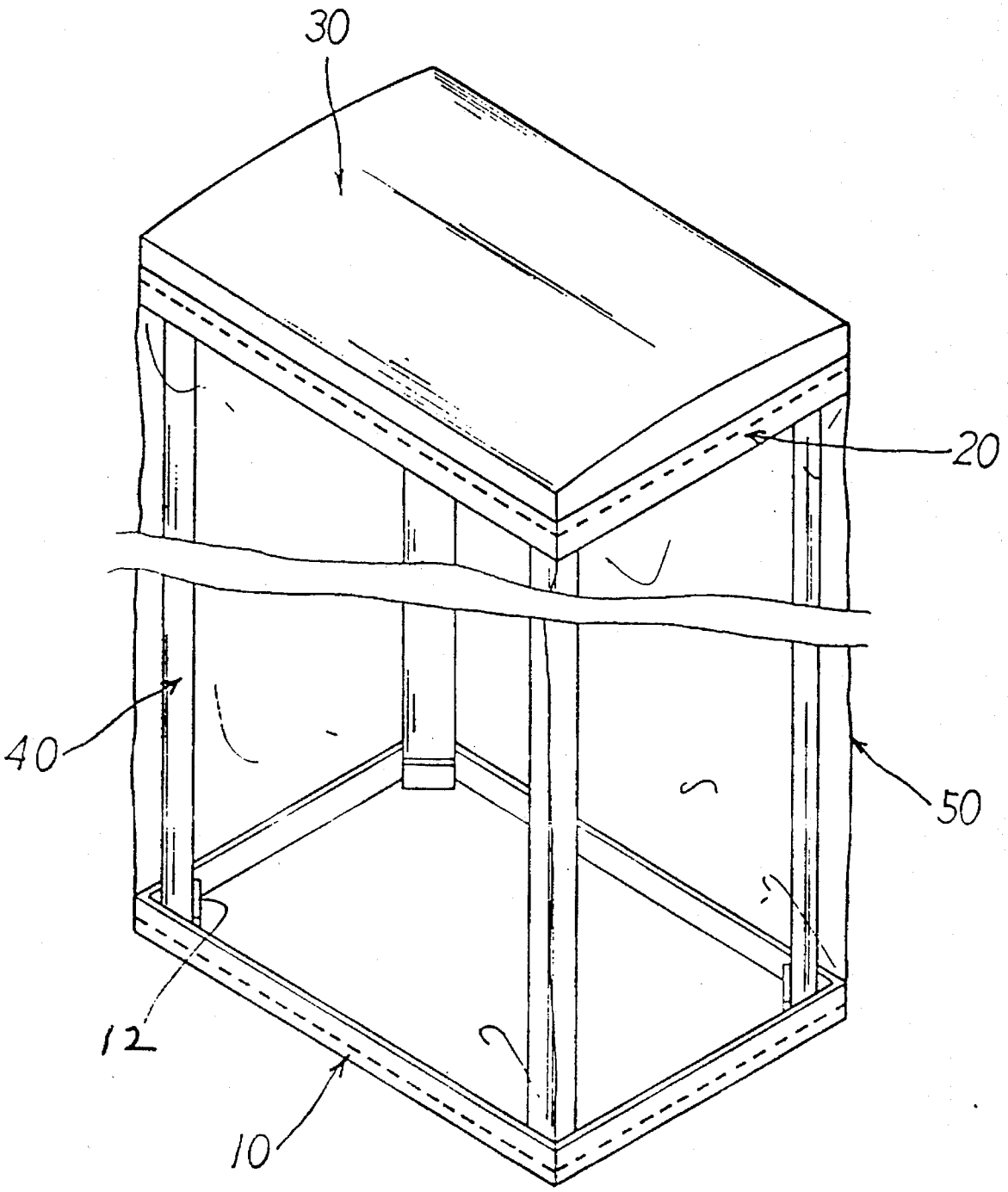
FIG. 2 (PRIOR ART)
FIG. 2 is a perspective assembled view of the conventional laundry container.
Figure 3:
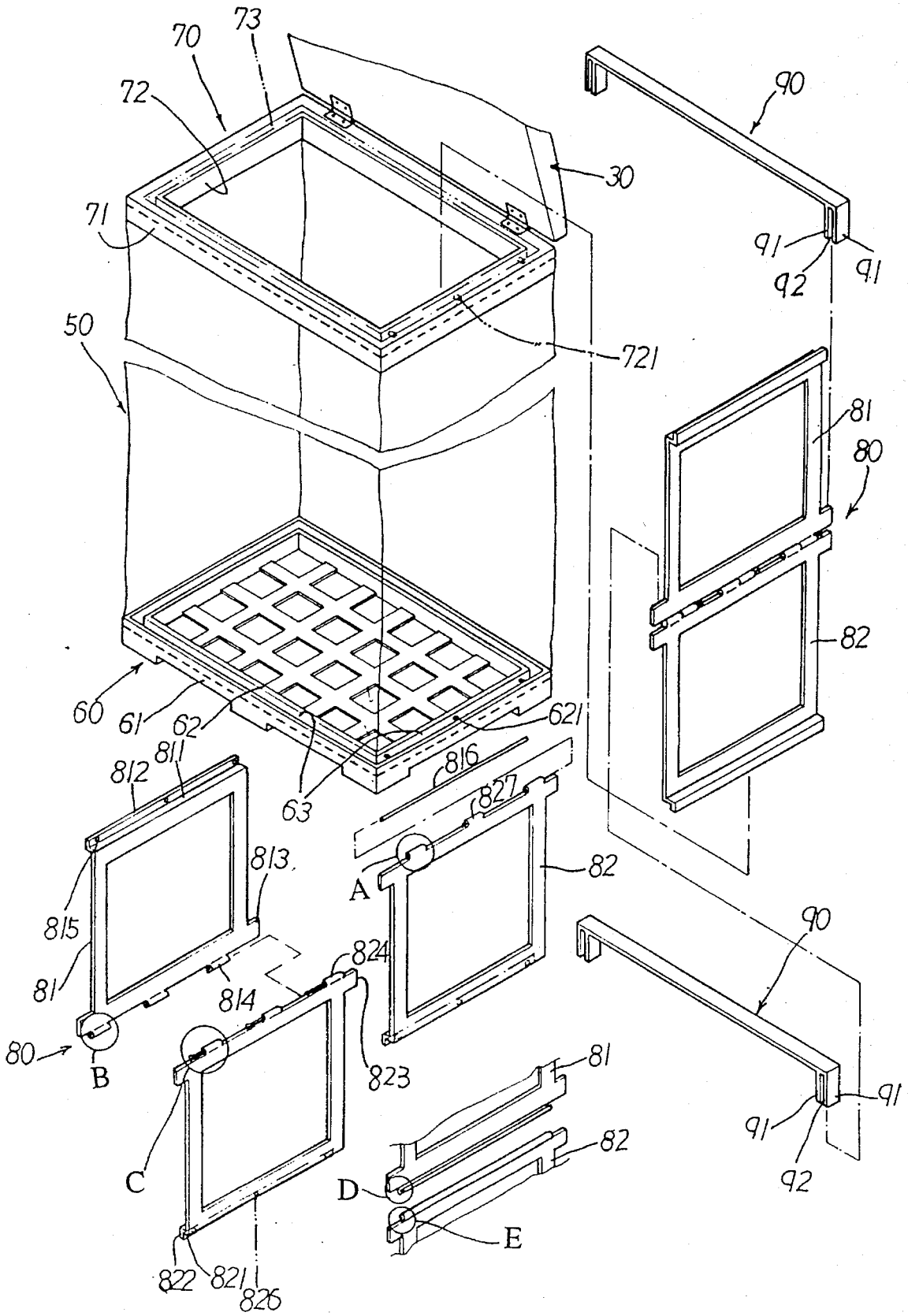
FIG. 3 is a perspective exploded view of the present invention.
Figure 3A:
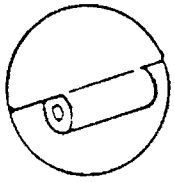
FIG. 3A is an enlarged view of the circled area A in FIG. 3.
Figure 3B:
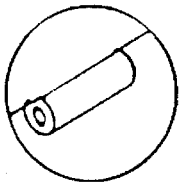
FIG. 3B is an enlarged view of the circled area B in FIG. 3.
Figure 3C:
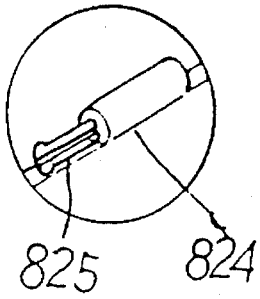
FIG. 3C is an enlarged view of the circled area C in FIG. 3.
Figure 3D:
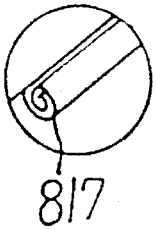
FIG. 3D is an enlarged view of the circled area D in FIG. 3.
Figure 3E:
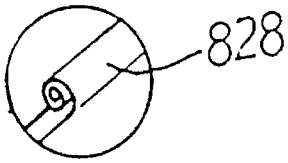
FIG. 3E is an enlarged view of the circled area E in FIG. 3.

Please refer to FIGS. 3–3E. The laundry container of the presents invention includes a cover body 30, a waterproof shade 50, a base seat 60, an upper frame 70, two support plate assemblies 80 and two fixing beams 90. The base seat 60 has an upward projecting outer periphery 61 and an upward project inner periphery 62 which define a peripheral groove 63. Several equally spaced bosses 621 are disposed on left and right outer sides of the inner periphery 62. The upper frame 70 has a downward projecting outer periphery 71 and a downward projecting inner periphery 72 which define a peripheral groove 73. Several equally spaced bosses 721 are disposed on left and right outer sides of the inner periphery 72. Each, support plate assembly 80 includes an upper support plate 81 and a lower support plate 82. The upper support plate 81 has an outward extending horizontal face 811 along upper edge and an upward extending flange 812 along outer edge of the horizontal face 811. Several equally spaced dents 815 are formed on inner side of the flange 812. Two projections 813 are disposed at two ends of lower edge of the upper support plate 81. Several fitting sleeves 814 are disposed on the lower edge of the upper support plate 81. The lower support plate 82 has an outward extending horizontal face 821 along lower edge and a downward extending flange 822 along outer edge of the horizontal face 821. Several equally spaced dents 826 are formed on inner side of the flange 822. Two projections 823 are disposed at two ends of upper edge of the lower support plate 82. Several insertion bodies 824 are disposed on the upper edge of the lower support plate 82. Each insertion body 824 has an insertion pin 825 at one end. The insertion pin 825 has a ball head and is cut with a fissure. Two pairs of engaging less 91 are respectively disposed at two ends of each fixing beam 90. Each pair of engaging legs 91 define an engaging notch 92 therebetween. The cover body 30 is pivotally connected with a rear edge of the upper frame 70. An upper edge of the waterproof shade 50 is secured on outer periphery of the upper frame 70 and a lower edge of the waterproof shade 50 is secured on outer periphery of the base seat 60. According to another preferred embodiment of the present invention, several fitting sleeves 827 are disposed on the upper edge of the lower support plate 82 instead of the insertion bodies 824 and a rod member 816 is inserted into the fitting sleeves 814 and 827 to pivotally connect the upper support plate with the lower support plate. According to still another preferred embodiment of the present invention, several spiral fitting members 817 are disposed on the lower edge of the upper support plate 81 instead of the fitting sleeves 814 and several cooperative spiral fitting members 828 are disposed on the upper edge of the lower support plate 82 instead of the insertion bodies 824.

Figure 4:
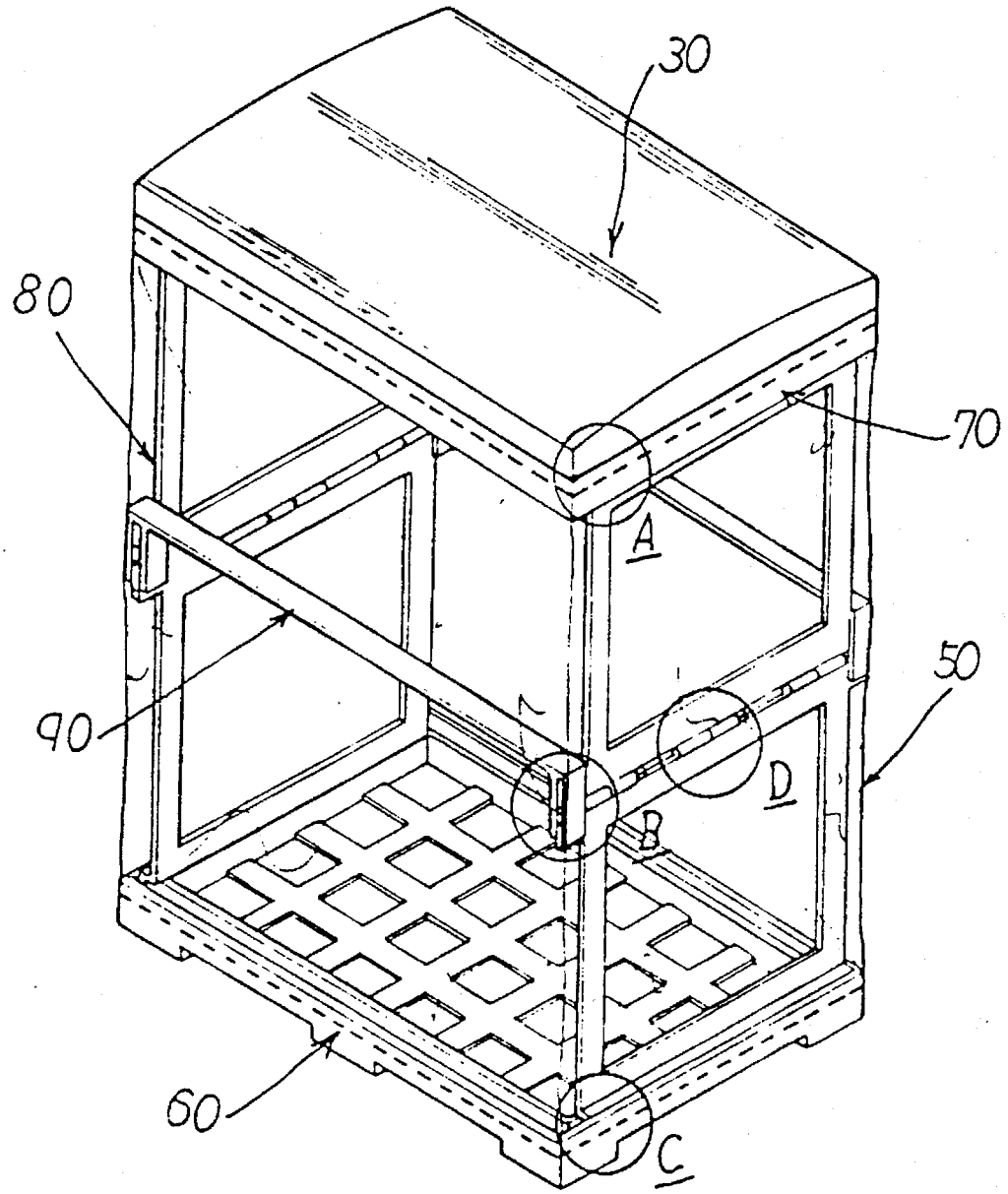
FIG. 4 is a perspective assembled view of the present invention.
Figure 4A:
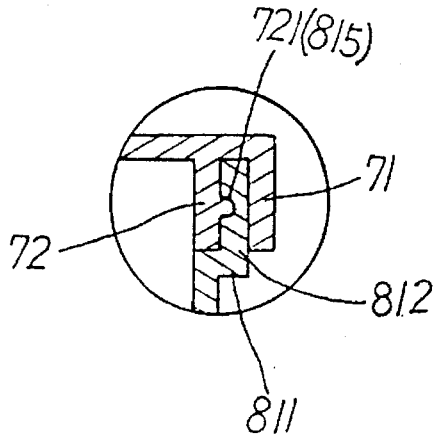
FIG. 4A is an enlarged sectional view of part A of FIG. 4.
Figure 4B:
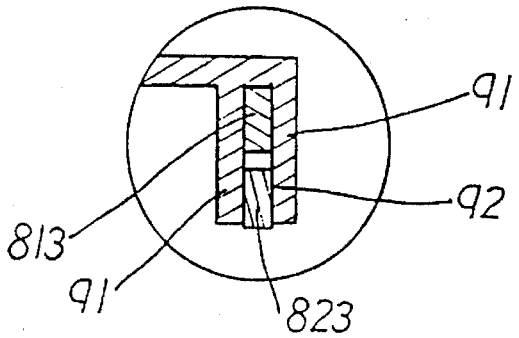
FIG. 4B is an enlarged sectional view of part B of FIG. 4.
Figure 4C:
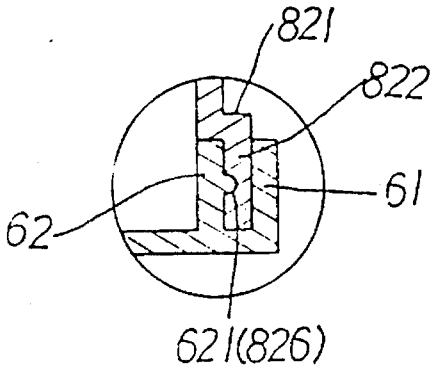
FIG. 4C is an enlarged sectional view of part C of FIG. 4.
Figures 1, 4D:
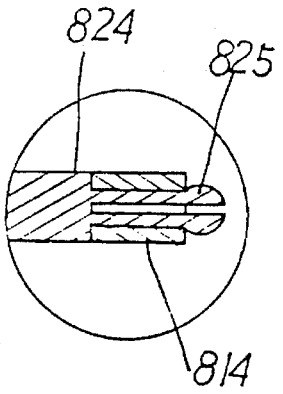
Figures 2, 4D:
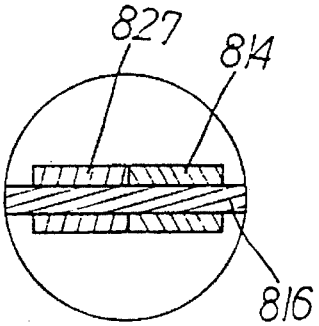
Figures 3, 4D:
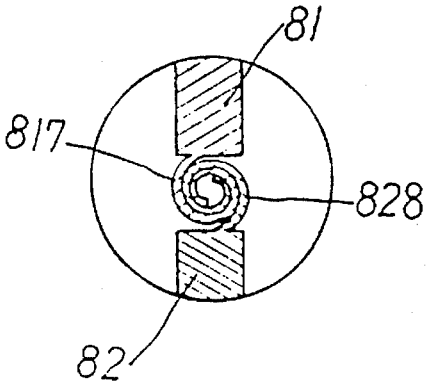

Please refer to FIGS. 4 to 4D-3. When assembled, the insertion pins 825 of the insertion bodies 824 of the lower support plates 82 are respectively inserted into the fitting sleeves 814 of the upper support plates 81 to form the two support plate assemblies 80. Alternatively, with respect to the lower support plates with fitting sleeves 827, the rod members 816 are inserted into the fitting sleeves 814 of the upper support plates 81 and the fitting sleeves 827 of the lower support plates 82 to form the two support plate assemblies 80. With respect to the upper and lower support plates with spiral fitting members 817, 828, the spiral fitting members 828 of the lower support plates 82 are fitted with the spiral fitting members 817 of the upper support plates 81 to form the two support plate assemblies 80. Then the flanges 822 of the lower support plates 82 are inserted into the left and right sides of the peripheral groove 63 of the base seat 60 with the bosses 621 of the inner periphery 62 of the base seat 60 engaged in the dents 826 of the flanges 822 of the lower support plates 82. Then the flanges 812 of the upper support plates 81 are inserted into the left and right sides of the peripheral groove 73 of the upper frame 70 with the bosses 721 of the inner periphery 72 of the upper frame 70 engaged in the dents 815 of the flanges 812 of the upper support plates 81. At this time, the waterproof shade 50 is in a stretched state. Then the projections 813, 823 of the upper and lower support plates 81, 82 are inserted into the engaging notches 92 of the engaging legs 91 of the fixing beams 90 to complete the assembly.

Figure 5:
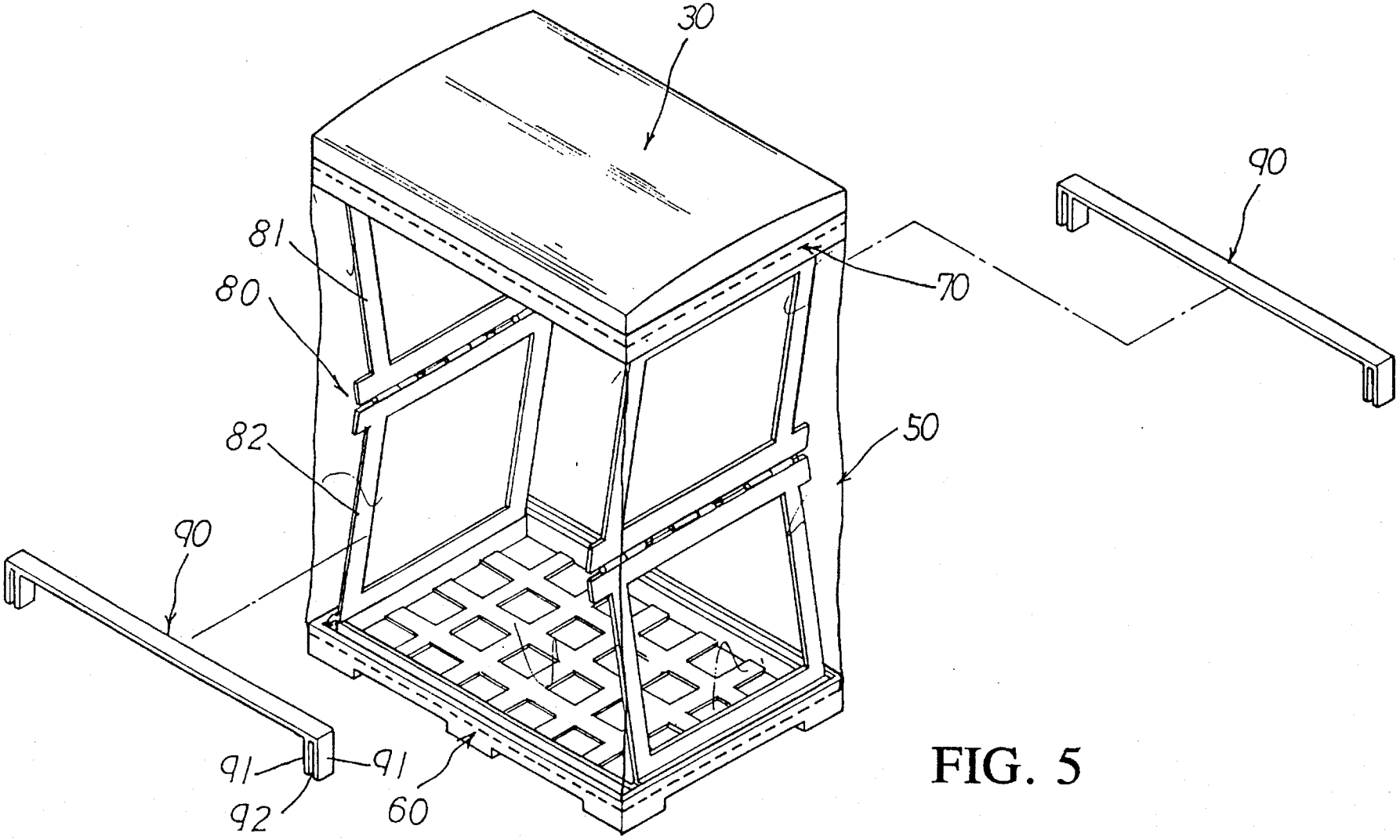
FIG. 5 is a perspective view of the present invention in a folded state.

Please refer to FIG. 5. When the laundry container is not used, the two fixing beams 90 are removed, permitting the upper and lower support plates 81, 82 of the support plate assemblies 80 to be inward folded and overlapped on each other. Therefore, the laundry container can be collapsed with the upper frame 70 rested on the base seat 60 so as to reduce occupied room.

The present invention has the following advantages:

1. The laundry container is supported by the two support plate assemblies 80 and the fixing beams 90 and thus has more concrete structure.

2. The upper frame 70 and the base seat 60 are more firmly connected with the support plate assemblies 80 by means of the engagement between the bosses 621, 721 and dents 815, 826 so that even in the case that the laundry container containing heavy weight of laundry is moved, the laundry container will not swing to cause detachment of the base seat 60 from the support plate assemblies 80.

The above embodiment is only an example of the present invention and the scope of the present invention should not be limited to the example. Any modification or variation derived from the example should fall within the scope of the present invention.

What is claimed is:

1. A laundry container comprising a cover body, a waterproof shade, a base seat, an upper frame, two support plate assemblies and two fixing beams, the cover body being pivotally connected with a rear edge of the upper frame, an upper edge of the waterproof shade being secured on outer periphery of the upper frame and a lower edge of the waterproof shade being secured on outer periphery of the base seat, said laundry container being characterized that:

the base seat has an upward projecting outer periphery and an upward projecting inner periphery which define a peripheral groove, several equally spaced bosses being disposed on left and right outer sides of the inner periphery;

the upper frame has a downward projecting outer periphery and a downward projecting inner periphery which define a peripheral groove, several equally spaced bosses being disposed on left and right outer sides of the inner periphery;

each support plate assembly includes an upper support plate and a lower support plate, the upper support plate having an outward extending horizontal face along upper edge and an upward extending flange along outer edge of the horizontal face, several equally spaced dents being formed on inner side of the flange, two projections being disposed at two ends of lower edge of the upper support plate, several fitting sleeves being disposed on the lower edge of the upper support plate the lower support plate having an outward extending horizontal face along lower edge and a downward extending flange along outer edge of the horizontal face, several equally spaced dents being formed on inner side of the flange, two projections being disposed at two ends of upper edge of the lower support plate, several insertion bodies being disposed on the upper edge of the lower support plate, each insertion body having an insertion pin at one end, the insertion pin having a ball head and being cut with a fissure; and two pairs of engaging legs are respectively disposed at two ends of each fixing beam, each pair of engaging legs defining an engaging notch therebetween, whereby the insertion pins of the insertion bodies of the lower support plates are respectively inserted into the fitting sleeves of the upper support plates to form the two support plate assemblies and then the flanges of the lower support plates are inserted into the left and right sides of the peripheral groove of the base seat with the bosses of the inner periphery of the base seat engaged in the dents of the flanges of the lower support plates and then the flanges of the upper support plates are inserted into the left and right sides of the peripheral groove of the upper frame with the bosses of the inner periphery of the upper frame engaged in the dents of the flanges of the upper support plates with the waterproof shade in a stretched state and then the projections of the upper and lower support plates are inserted into the engaging notches of the engaging legs of the fixing beams to complete the assembly.

2. A laundry container as claimed in claim 1 , wherein several fitting sleeves are disposed on the upper edge of the lower support plate instead of the insertion bodies and a rod member is inserted into the fitting sleeves of the upper support plate and the fitting sleeves of the lower support plate to pivotally connect the upper support plate with the lower support plate.

3. A laundry container as claimed in claim 1, wherein several spiral fitting members are disposed on the lower edge of the upper support plate instead of the fitting sleeves thereof and several cooperative spiral fitting members are disposed on the upper edge of the lower support plate instead of the insertion bodies thereof, whereby the spiral fitting members of the lower support plate are fitted with the spiral fitting members of the upper support plate pivotally connect the upper support plate with the lower support plate.

* * * * *